US006217378B1

(12) United States Patent
Wu

(10) Patent No.: US 6,217,378 B1
(45) Date of Patent: Apr. 17, 2001

(54) UNIVERSAL SERIAL BUS CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/344,307

(22) Filed: Jun. 24, 1999

(30) Foreign Application Priority Data

Dec. 11, 1998 (TW) ..... 87220685

(51) Int. Cl.[7] ..... H01R 13/60
(52) U.S. Cl. ..... 439/567; 439/607
(58) Field of Search ..... 439/610, 617, 439/567, 83, 884, 876, 571, 572, 573, 570, 563, 607

(56) References Cited

U.S. PATENT DOCUMENTS 4,668,040 * 5/1987 Wu ..... 439/567
5,409,386 * 4/1995 Banakis et al. ..... 439/83
5,961,351 * 10/1999 Wu ..... 439/610
5,971,802 * 10/1999 Pan et al. ..... 439/567
6,007,382 * 12/1999 Wu ..... 439/607
6,053,767 * 4/2000 Copper et al. ..... 439/567
6,077,115 * 10/1999 Yang et al. ..... 439/567

* cited by examiner

*Primary Examiner*—Neil Abrams
*Assistant Examiner*—J. F. Duverne
(74) *Attorney, Agent, or Firm*—Wei Te Chung

(57) ABSTRACT

An electrical connector includes a shielding casing (1) having a top section (11) and a bottom section (12) connected to each other by a rear section (13) and two side sections (14) to define an interior space therebetween. The shielding casing defines a front opening (10) for receiving a mating connector in the interior space. Each side section has a projection (140,141) transversely extending in opposite directions and forming a board lock (142). An insulative body (2) is fixed in the interior space and spaced from the top, bottom and side sections of the shielding section for receiving the mating connector. The insulative body retains contact elements (3) therein for electrically engaging with contacts of the mating connector.

12 Claims, 7 Drawing Sheets

UNIVERSAL SERIAL BUS CONNECTOR

BACKGROUND OF THE INVENTION

1. Field of the Invention

The present invention generally relates to an electrical connector, and in particular to a low profile, completely enclosed universal serial bus (USB) connector.

2. The Prior Art

A universal serial bus (USB) connector is commonly used in computer systems and networks. FIG. 1 shows a conventional USB connector which comprises an insulative body 5 having a top wall, a bottom wall and side walls for receiving and retaining contact elements 7 therein. A shielding casing 6 comprises top, bottom and side sections enclosing the insulative body 5 for protecting the contact elements 7 from electromagnetic interference (EMI). The shielding casing 6 is stamped from a metal sheet and the bottom section thereof forms boardlocks 61 engaging with holes defined in a circuit board 8 for retaining the USB connector on the circuit board 8. An example of the conventional USB connector is disclosed in Taiwan Patent Nos. 85212192 and 86207969.

The boardlocks 61 of the conventional USB connector are stamped on the bottom section of the connector thereby partially exposing the insulative body 5, leading to the deterioration of EMI protection properties. Furthermore, arranging the boardlocks 61 on the bottom side of the connector hinders the possibility of reducing the overall height of the connector above the circuit board 8.

Moreover, the contact elements 7 of the conventional USB connector are inserted into the insulative body 5 in a direction substantially parallel to a mating force applied thereto when engaging with a mating connector. This may result in displacement of the contact elements during engagement with the mating connector.

It is thus desirable to have an electrical connector that overcomes the problems mentioned above.

SUMMARY OF THE INVENTION

Accordingly, an object of the present invention is to provide an electrical connector comprising an insulative body completely enclosed by a shielding casing.

Another object of the present invention is to provide an electrical connector that has a low profile when mounted to a circuit board.

A further object of the present invention is to provide an electrical connector comprising contact elements that soundly withstand a mating force applied thereto by a mating connector.

To achieve the above objects, an electrical connector in accordance with the present invention comprises a shielding casing having a top section and a bottom section connected to each other by a rear section and two side sections to define an interior space therebetween. The shielding casing defines a front opening for receiving a mating connector in the interior space. Each side section has a projection transversely extending in opposite directions and forming a board lock. An insulative body is fixed in the interior space and spaced from the top, bottom and side sections of the shielding section for receiving the mating connector. The insulative body retains contact elements therein for electrically engaging with contacts of the mating connector.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
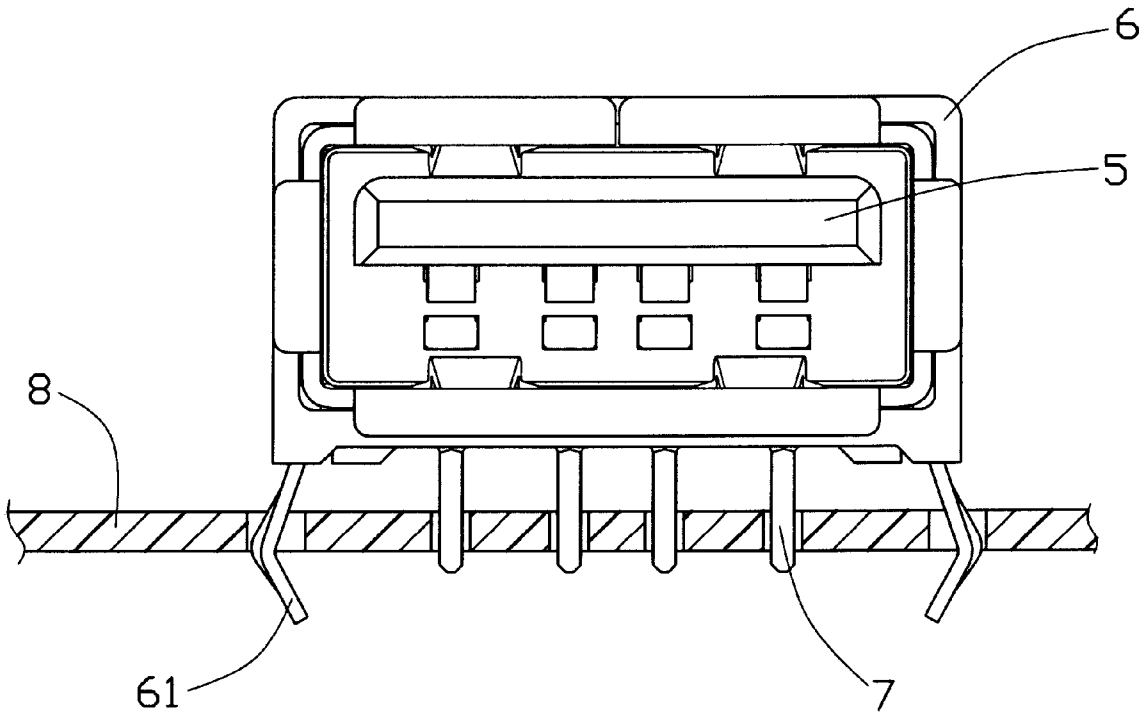
FIG.1 PRIOR ART
FIG. 1 is a front view of a conventional USB connector mounted on a circuit board.
Figure 2A:
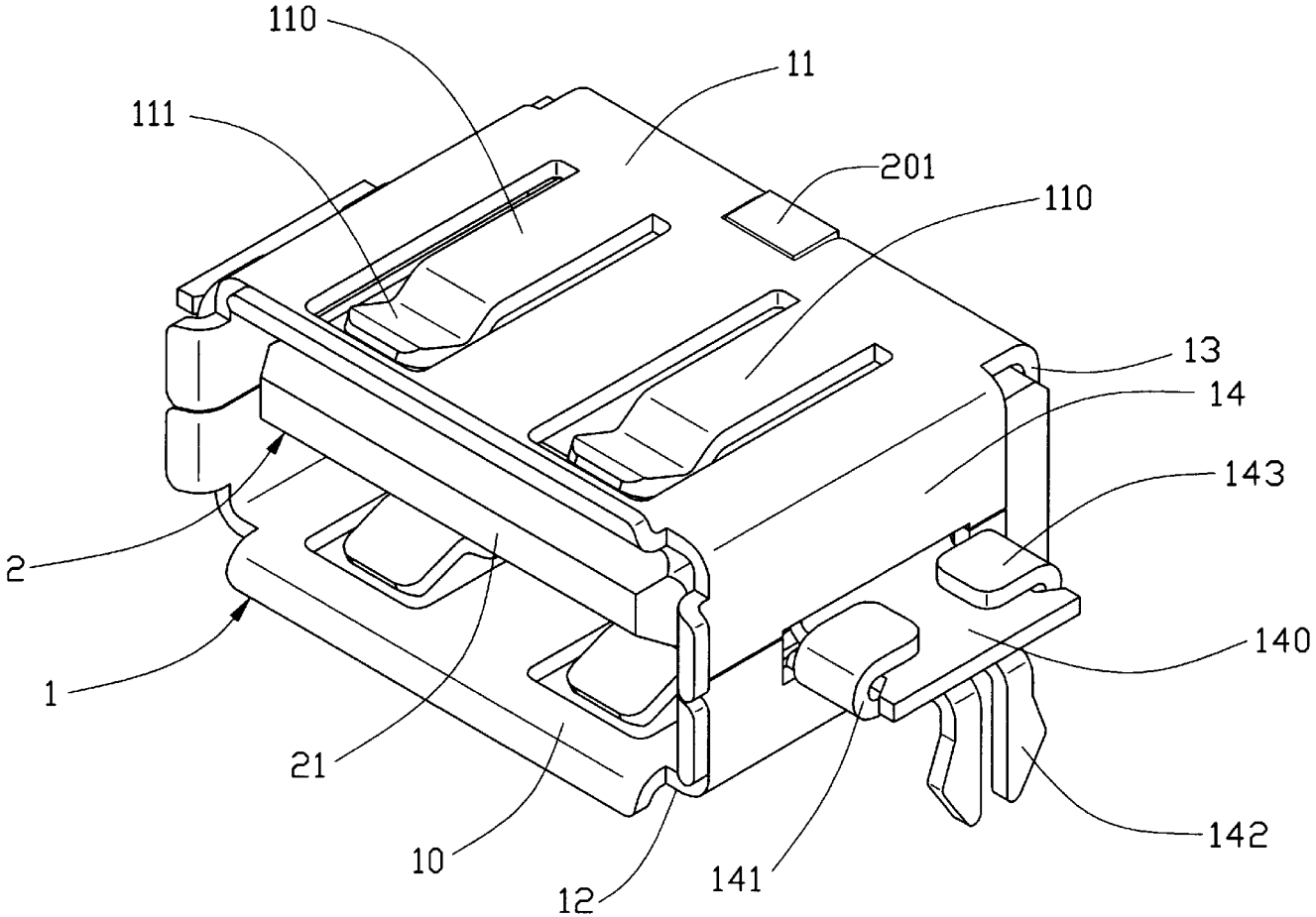
FIG. 2A is a perspective view of an electrical connector constructed in accordance with the present invention.
Figure 2B:
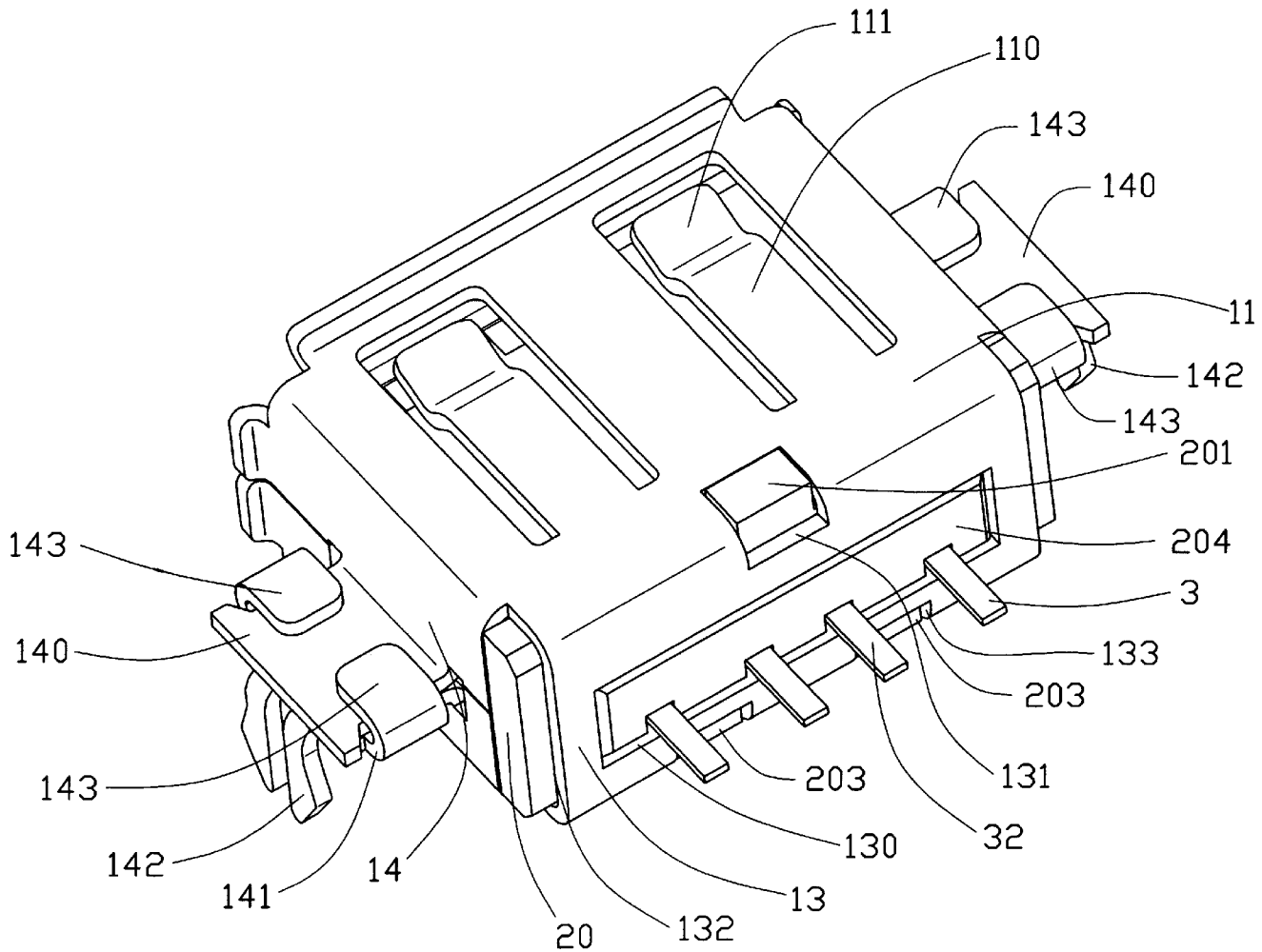
FIG. 2B is another perspective view of the electrical connector of the present invention.

Referring to the drawings and in particular to FIGS. 2A and 2B, a universal serial bus (USB) connector constructed in accordance with the present invention comprises a conductive shielding casing 1 having a top section 11 and a bottom section 12 connected by a rear section 13 to define an interior space therebetween for receiving an insulative body 2. The shielding casing 1 defines a front opening 10 for releasably receiving a mating connector (not shown).

Figure 3A:
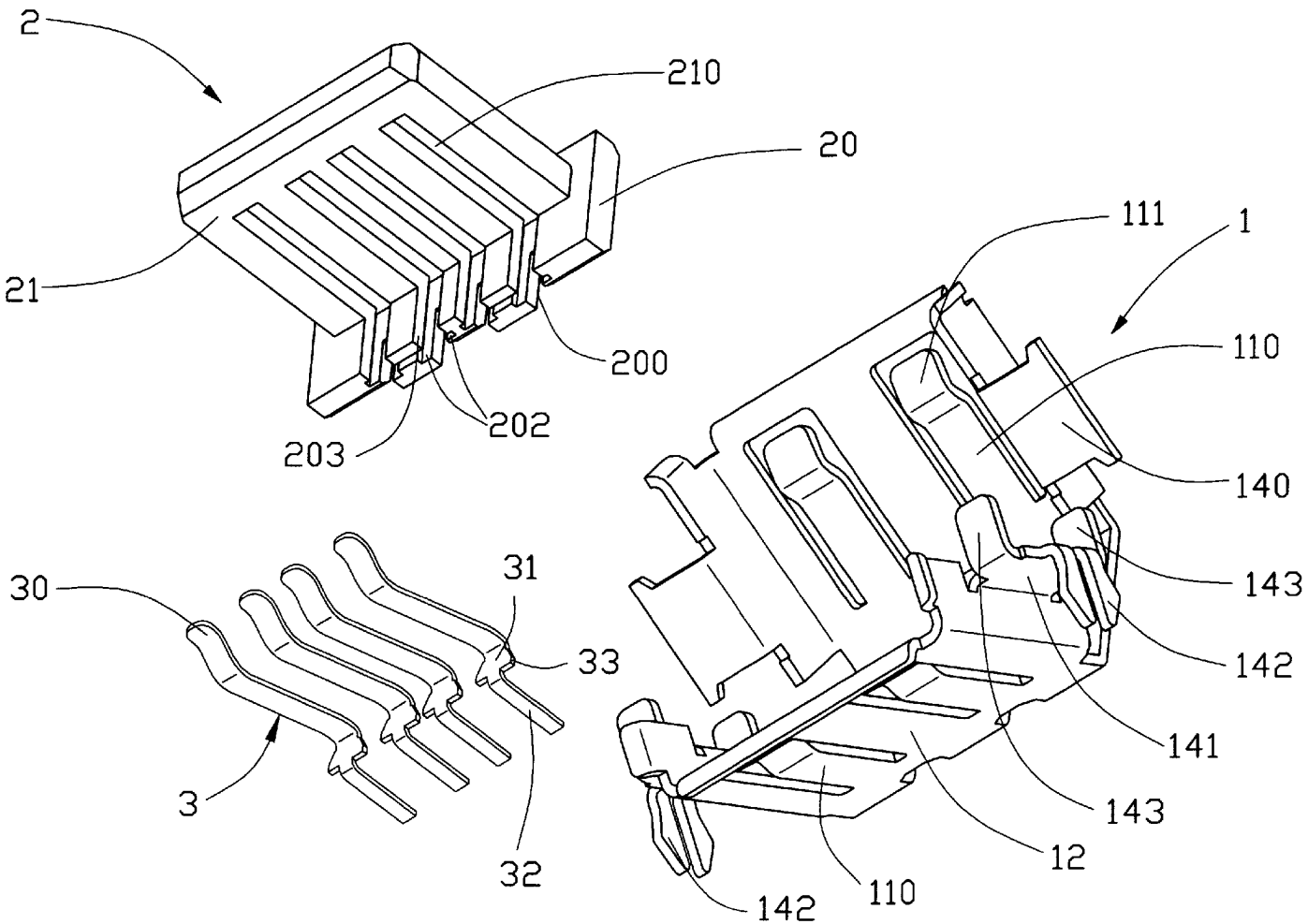
FIG. 3A is an exploded view of the electrical connector of the present invention.
Figure 3B:
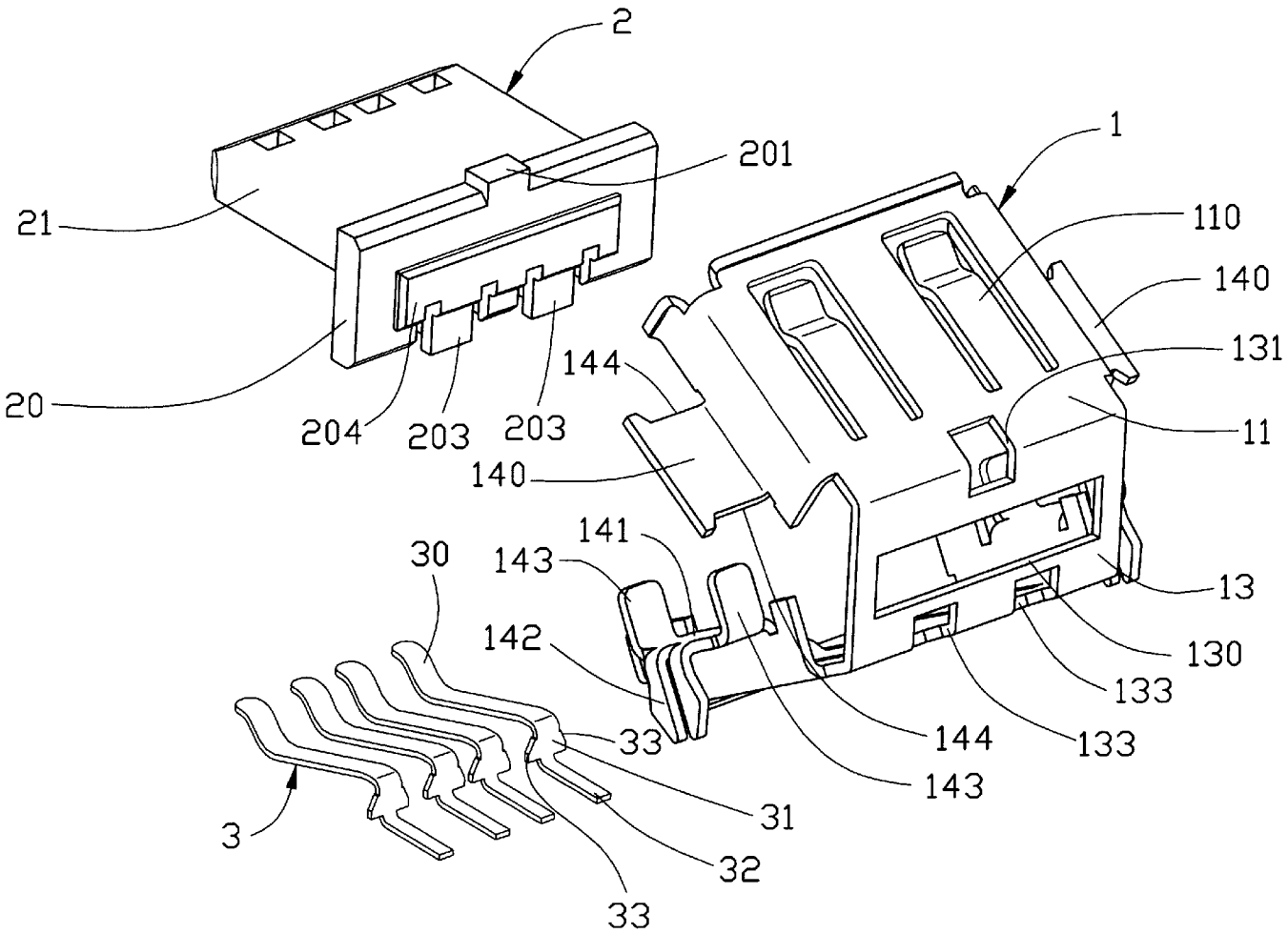
FIG. 3B is another exploded view of the electrical connector of the present invention.
Figure 3C:
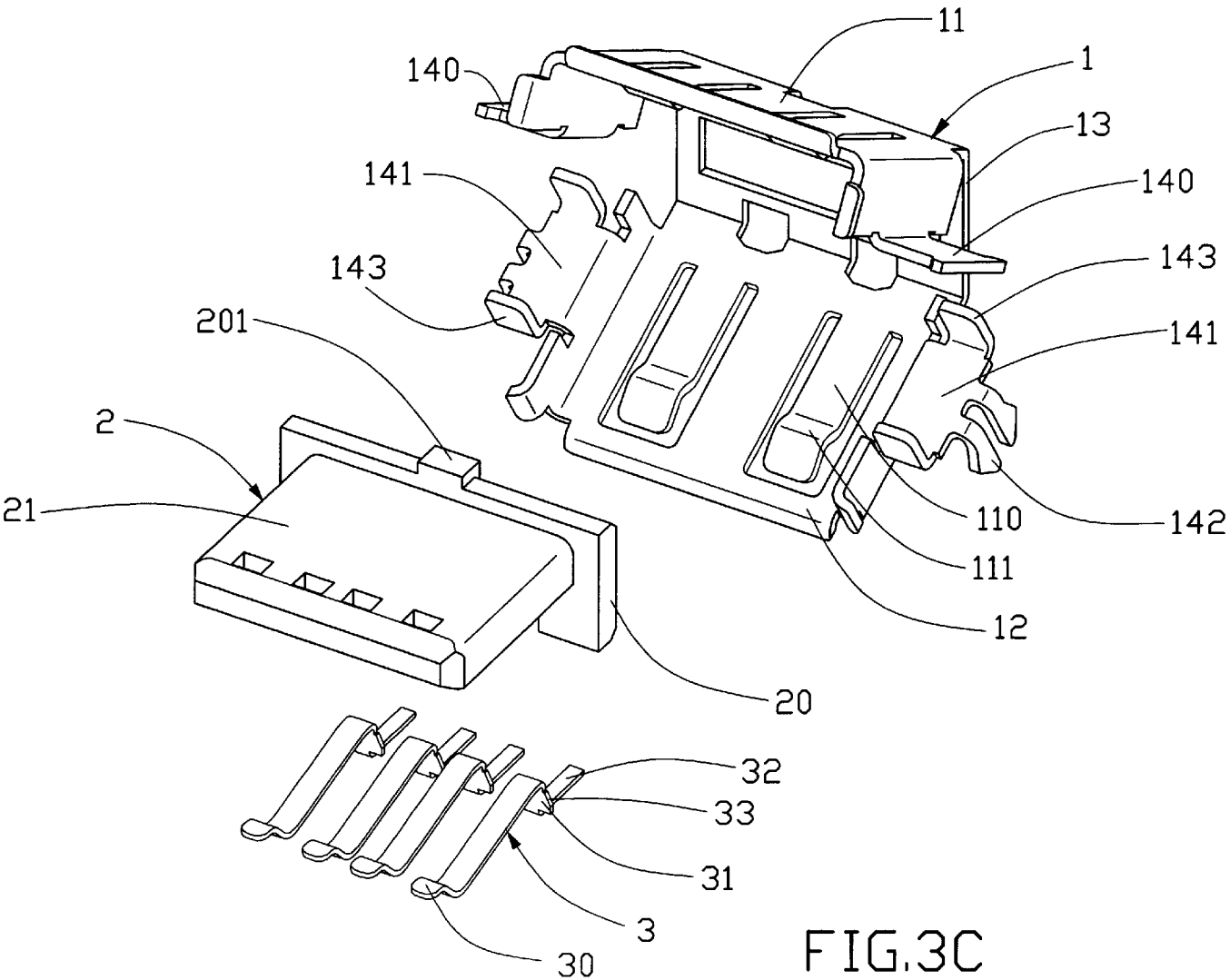
FIG. 3C is a further exploded view of the electrical connector of the present invention.
Figure 4:
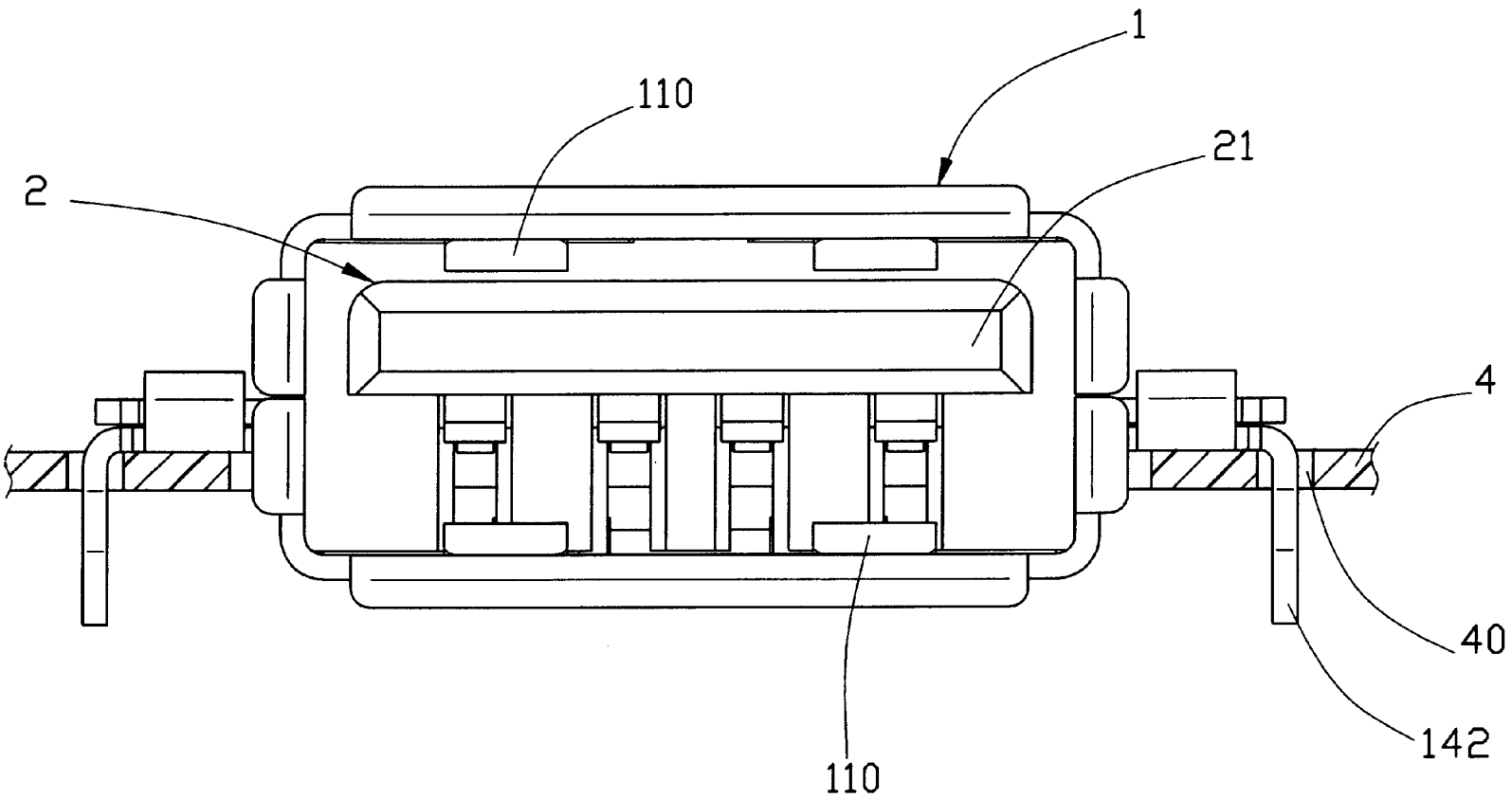
FIG. 4 is a front view of the electrical connector of the present invention mounted on a circuit board.

As shown in FIGS. 3A, 3B and 3C, the shielding casing 1 is made by stamping and bending a metal sheet to form the top section 11, the rear section 13 and the bottom section 12. Top and bottom flanges (not labeled) extend from opposite edges of the top and bottom sections 11, 12 and contact each other to form side sections 14 of the shielding casing 1. Each top flange extending from the top section 11 has a first transverse extension 140 offset from and substantially parallel to the top section 11. Each bottom flange extending from the bottom section 12 has a second transverse extension 141 offset from and substantially parallel to the bottom section 12. The first transverse extensions 140 overlap the corresponding second transverse extensions 141 to form side projections of the shielding casing 1. Each second transverse extension 141 forms two opposite tabs 143 which are bent to overlap and thus secure the first transverse extension 140 to the second transverse extension 141. Preferably, each first transverse extension 140 defines a pair of recesses 144 in opposite edges thereof for receiving the tabs 143 of the second transverse extension 141. Each second transverse extension 141 further forms a pair of spaced resilient barbs 142 to serve as a boardlock which, as shown in FIG. 4, is received in a corresponding hole 40 defined in a circuit board 4 for mounting the connector to the circuit board 4.

The top section 11 and the bottom section 12 of the shielding casing 1 form resilient arms 110 having an inward projection 111 extending into the interior space of the shielding casing 1 for engaging with the mating connector and thus mechanically retaining the mating connector and establishing electrical engagement therebetween for grounding purposes.

The insulative body 2 defines a plurality of grooves 210 in a face 21 thereof for receiving contact elements 3 therein. The insulative body 2 is spaced from the top section 11, the bottom section 12 and the side sections 14 47 of the shielding casing 1 for receiving the mating connector therein to establish electrical connection between the contact elements 3 and the mating connector.

The insulative body 2 comprises a back plate 20 in which channels 200 are defined corresponding to and in communication with the grooves 210. Each channel 200 has two opposite inside faces 203 each defining a slit 202 therein.

Each contact element 3 comprises a mating section 30 and a mounting section 32 offset from and substantially parallel to the mating section 30. A retention section 31 substantially normal to both the mating section 30 and the mounting section 32 is formed therebetween. The retention section 31 has two side projections 33 interferentially received and retained in the slits 202 of the corresponding channel 200 with the mounting section 32 extending beyond the back plate 20 through the channel 200 and the mating section 30 received in the groove 210.

Since the retention section 33 is substantially normal to the mating section 30, a mating force applied to each contact element 3 while engaging the mating connector with the USB connector is substantially normal to the back plate 20 and absorbed thereby. Thus, the contact element 3 is firmly retained and will not be displaced by the mating force.

The shielding casing 1 forms an opening 132 (FIG. 2B) between the rear section 13 and each side section 14 for receiving a lateral end of the back plate 20 with the back plate 20 abutting against an inside face of the rear section 13 thereby securely fixing the insulative body 2 in the shielding casing 1. The back plate 20 of the insulative body 2 forms a top block 201 and two bottom blocks 203 which are respectively received in openings 131, 133 defined in the top section 11 and the bottom section 12 of the shielding casing 1 for retaining the insulative body 2 in the shielding casing 1. The back plate 20 further comprises a rear block 204 received in an opening 130 defined in the rear section 13 of the shielding casing 1 for further retaining the insulative body 2 in the shielding casing 1. The mounting sections 32 of the contact elements 3 extend beyond the casing 1 through the rear opening 130.

Preferably, the mounting sections 32 of the contact elements 3 lie in the same plane as the second transverse extensions 141 of the shielding casing 1 whereby when the connector is mounted to the circuit board 4 with the second transverse extensions 141 supported on the circuit board 4, the mounting sections 32 of the contact elements 3 are positioned to be surface mountable on the circuit board 4.

The transverse extensions 140, 141 allow the connector to be mounted to an edge of the circuit board 4 thereby reducing the height of the connector above the circuit board 4 and forming a low profile connector configuration as shown in FIG. 4. Furthermore, forming boardlocks on the second transverse extensions 141 rather than on the bottom section 12 of the shielding casing 1 allows the connector to be entirely enclosed by the shielding casing 1 thereby more fully eliminating electromagnetic interference.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

a shielding casing having a top section and a bottom section connected to each other by a rear section and two side sections to define an interior space therebetween, the shielding casing defining a front opening adapted to receive a mating connector in the interior space, each side section comprising a top half extending from an edge of the top section, a bottom half extending from an edge of the bottom section, and a projection transversely extending from the side section, the projection comprising a first transvere extension extending from the top half and a second transverse extension extending from the bottom half and overlapped by the first transverse extension, the second transverse extension forming two opposite tabs which are bent to overlap and thus to secure the first transverse extension to the second transverse extension, a board lock being formed on the projection; and an insulative body fixed in the interior space and spaced from the top, bottom and side sections of the shielding casing for receiving the mating connector, the insulative body retaining contact elements therein adapted to electrically engage with contacts of the mating connector.

2. The electrical connector as claimed in claim 1, wherein the projections of the shielding casing are adapted to be supported on a circuit board with the boardlocks engaging with holes defined in the circuit board.

3. The electrical connector as claimed in claim 2, wherein each contact element has a mounting section extending beyond the shielding casing and lying in the same plane as the projections of the shielding casing for being surface mounted to the circuit board.

4. The electrical connector as claimed in claim 2, wherein the projections extend from the side sections substantially midway between the top and bottom sections thereby forming a low profile connector.

5. The electrical connector as claimed in claim 1, wherein the first transverse extension defines a pair of recesses in opposite edges thereof for receiving the tabs of the second transverse extension therein.

6. The electrical connector as claimed in claim 1, wherein the second transverse extension further forms a pair of resilient barbs serving as the boardlock.

7. The electrical connector as claimed in claim 1, wherein each contact element comprises a mating section which is offset from and substantially parallel to a mounting section thereof and connected thereto by a retention section substantially normal to the mating section and the mounting section, and wherein the insulative body has a face defining grooves therein for receiving the mating sections of the contact elements, the insulative body further comprising a back plate defining a number of channels therein corresponding to and communicating with the grooves for receiving the retention sections of the contact elements with the mounting sections extending therethrough, the retention section of each contact element comprising opposite side projections interferentially received in slits defined in opposite inside faces of the corresponding channel thereby securely retaining the contact element in the insulative body and soundly supporting the contact element to withstand a mating force applied to the contact element by the mating connector.

8. The electrical connector as claimed in claim 7, wherein the back plate of the insulative body has two opposite ends respectively received and retained in openings defined between the rear section and the two side sections of the shielding casing with the back plate abutting against an inside surface of the rear section.

9. The electrical connector as claimed in claim 8, wherein the back plate has a rear block received in a rear opening defined in the rear section.

10. The electrical connector as claimed in claim 9, wherein the mounting sections of the contact elements extend beyond the shielding casing through the rear opening defined in the rear section of the shielding casing.

11. The electrical connector as claimed in claim 9, wherein the back plate of the insulative body forms positioning blocks on top and bottom edges thereof, the positioning blocks being received in openings defined in the top and bottom sections of the shielding casing.

12. An electrical connector comprising:

a shielding casing having a top section and a bottom section connected to each other by a rear section and two opposite side sections to define an interior space therebetween, the shielding casing defining a front opening adapted to receive a mating connector in the interior space, each side section having a projection transversely extending in opposite directions, a board lock being formed on the projection; and an insulative body fixed in the interior space and spaced from the top, bottom and side sections of the shielding section for receiving the mating connector, the insulative body retaining a plurality of contact elements therein, said contact elements being shielded by the shielding casing and adapted to electrically engage with contacts of the mating connector;

each contact element comprising a mating section and a mounting section which are offset from and substantially parallel to each other and connected to each other by a retention section substantially normal thereto, the insulative body having a face defining grooves therein for receiving the mating sections of the contact elements, the insulative body further comprising a back plate defining a number of channels therein corresponding to and communicating with the grooves for receiving the retention sections of the contact elements with the mounting sections extending therethrough, the retention section of each contact element comprising opposite side projections interferentially received in slits defined in opposite inside faces of the corresponding channel thereby securely retaining the contact element in the insulative body and soundly supporting the contact element against a mating force applied to the contact element by a mating connector.

* * * * *